US005120061A

United States Patent [19]

Tsuchida et al.

[11] Patent Number: 5,120,061

[45] Date of Patent: Jun. 9, 1992

[54] GOLF CLUB HEAD

[75] Inventors: Atsushi Tsuchida; Ryohei Tajima, both of Shizuoka, Japan

[73] Assignee: Yamaha Corporation, Japan

[21] Appl. No.: 511,064

[22] Filed: Apr. 19, 1990

[30] Foreign Application Priority Data

| | | | |
|---|---|---|---|
| Apr. 19, 1989 | [JP] | Japan | 1-99827 |
| Apr. 27, 1989 | [JP] | Japan | 1-108194 |
| May 16, 1989 | [JP] | Japan | 1-122638 |

[51] Int. Cl.[5] ..... A63B 53/04

[52] U.S. Cl. ..... 273/167 E; 273/80 C; 273/80.2

[58] Field of Search ..... 273/80 R-80 C, 273/80.2-80.9, 169, 167 E, 167 R

[56] References Cited

U.S. PATENT DOCUMENTS

| | | | |
|---|---|---|---|
| 959,053 | 5/1910 | Fowler | 273/80 C |
| 1,396,470 | 11/1921 | Taylor | 273/167 E |
| 1,514,958 | 11/1924 | Dutcher | 273/80 R |
| 1,528,017 | 3/1925 | Gammeter | 273/167 E |
| 1,787,415 | 12/1930 | Washington | 273/80.8 |
| 2,018,723 | 10/1935 | Hutchison | 273/80.2 |
| 2,027,635 | 1/1936 | Cunningham | 273/80.2 |
| 2,088,095 | 7/1937 | Sargent et al. | 273/167 E |
| 3,947,041 | 3/1976 | Barber | 273/167 G |
| 4,632,400 | 12/1986 | Boone | 273/164 |
| 4,892,316 | 1/1990 | Langert et al. | 273/167 E |
| 4,955,610 | 9/1990 | Creighton | 273/80 C |

FOREIGN PATENT DOCUMENTS

| | | | |
|---|---|---|---|
| 800882 | 7/1936 | France | 273/80 R |
| 13712 | of 1905 | United Kingdom | 273/80 R |
| 489638 | 10/1936 | United Kingdom | 273/80 R |
| 1078412 | 8/1967 | United Kingdom | 273/167 E |

OTHER PUBLICATIONS

"Golf Digest", Magazine, Aug. 1979 Issue, p. 25.

*Primary Examiner*—Edward M. Coven
*Assistant Examiner*—Sebastiano Passaniti
*Attorney, Agent, or Firm*—Ostrolenk, Faber, Gerb & Soffen

[57] ABSTRACT

For improvement in aerodynamic characteristics of a golf club head at swing, the transverse cross-section of the hosel is defined by a winged profile which includes at least one of a convex heel and concave toe sections. The sole face is defined by a convex sphere of a specified radius of curvature. The crown and sole faces are defined with vertical symmetry by respective convex spheres of similar radii of curvature. Current transition around the club head at swing is well prevented for higher head speed. Bias buoyancy at swing are minimized for a stabilized swing line.

19 Claims, 6 Drawing Sheets

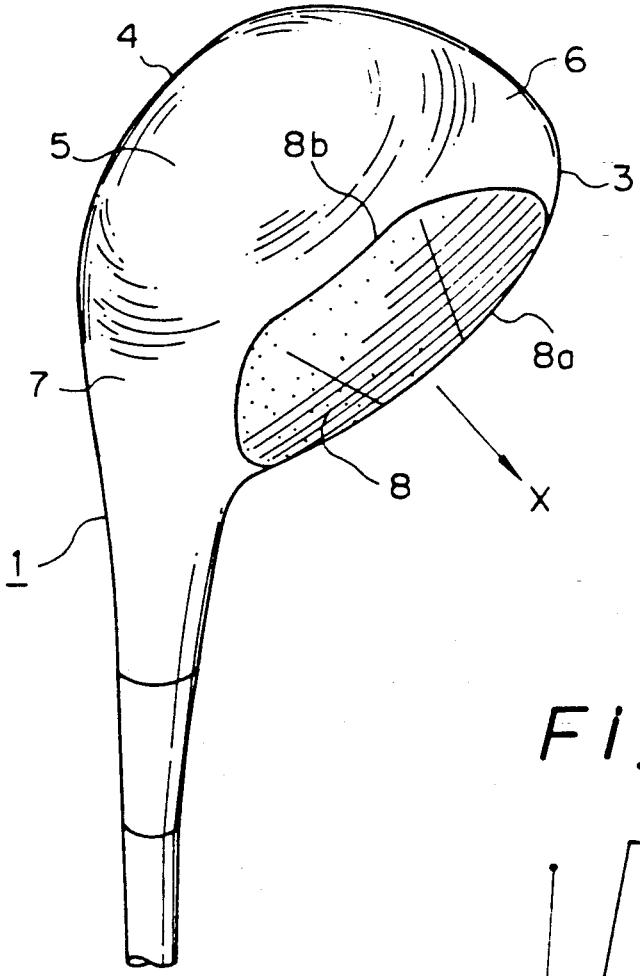
Fig. 3
Fig. 4
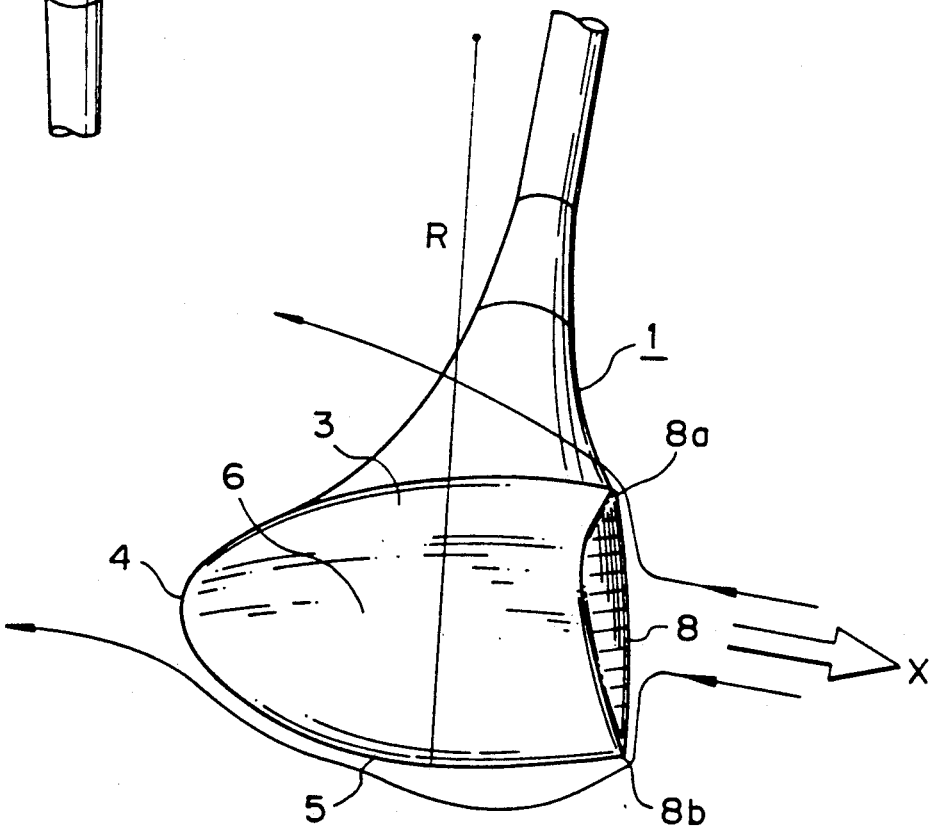

Fig. 7
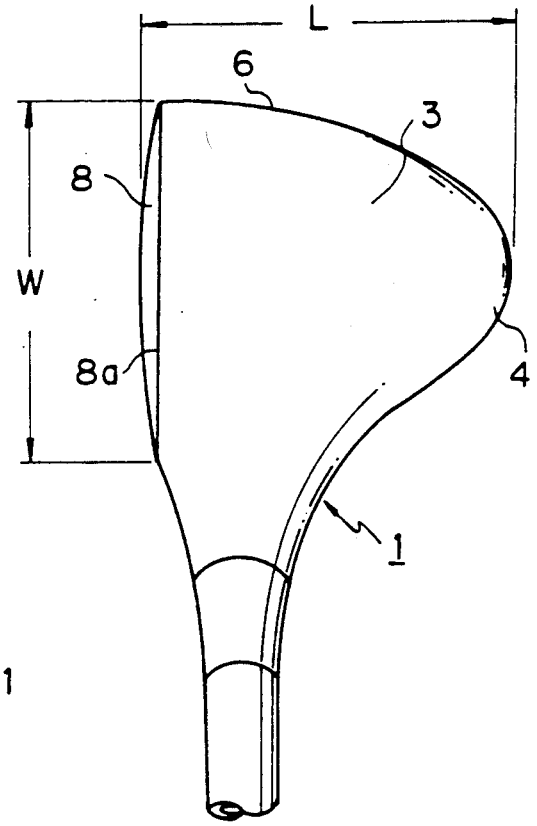
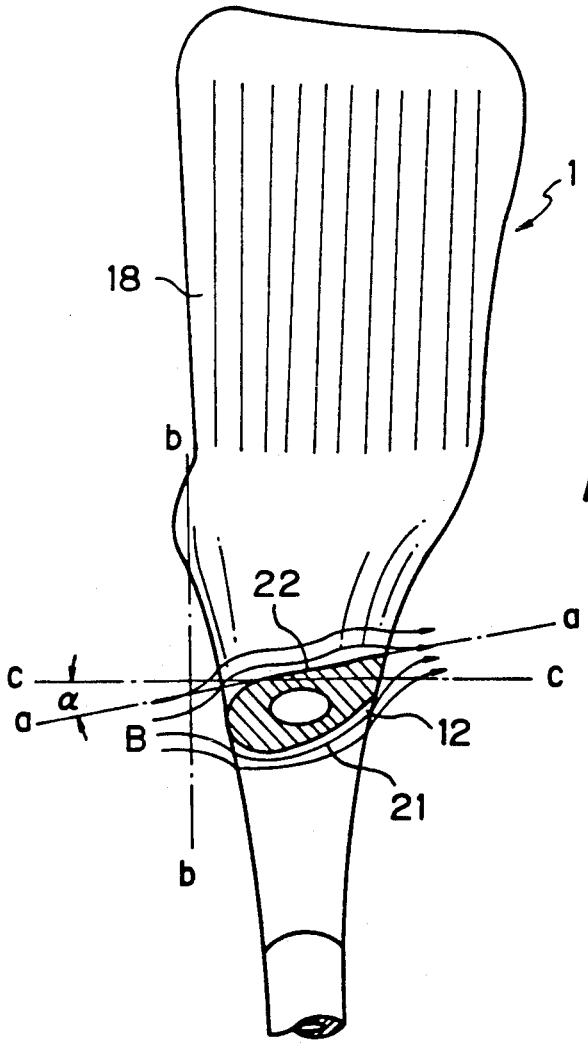
Fig. 8

GOLF CLUB HEAD

BACKGROUND OF THE INVENTION

The present invention relates to a golf club head, and more particularly relates to improvements in aerodynamic characteristics of a golf club head.

It is generally known that air current generated around the club head when the golf club is swung has a great influence on the head speed and stability of the swing line.

Conventional golf club heads generally have a hosel of a circular transverse cross-sectional profile. As a result, air current generated near the center of a club head when the head is swung becomes faster than that near the hosel, in particular when the head speed is in a range from 30 to 60 m/sec, and this difference in air current speed generates a sort of bias which urges the head main body to move towards the toe. This bias tends to disturb the stability of the swing line. Further, the circular cross-sectional profile of the conventional hosel forces air current near the hosel to shift from parallel flow to turbulent flow and such current transition induces increased pneumatic resistance, thereby greatly lowering the head speed when the club is swung.

Not only the transverse cross-sectional profile of the hosel but also the entire configuration of the head main body, affects stability of the swing line. In the configuration of a conventional golf club head, the borders between the shooting face, crown face and sole face are demarcated by edge lines having acute angles. The presence of such sharp edge lines greatly disturbs the pneumatic current near the borders when the club is swung and, as a consequence, increases the pneumatic resistance, thereby lowering the head speed. In addition, the loft of the shooting face produces negative buoyancy which is smaller in magnitude than positive buoyancy produced by the crown face and the sole face. Positive buoyancy resulting from this difference greatly disturbs the stability of the swing line.

In an attempt to prevent such current transition, Japanese Patent Publication Sho. 53-31417 proposes to form an elongated groove called a trip step in the upper edge of the shooting face of a golf club head, and Japanese Patent Opening Sho. 62-176469 proposes to form many fine grooves in the crown and sole faces of a golf club head. In practice, however, these prior proposals do not provide a sufficient solution to the problem of aerodynamic characteristics inherent to the conventional golf club head.

SUMMARY OF THE INVENTION

It is a primary object of the present invention to improve pneumatic characteristics of a golf club head by preventing generation of bias, buoyancy and current transition when the club is swung.

In accordance with the first aspect of the present invention, the hosel of a golf club head has a transverse cross-section of a winged profile defined by at least one of a convex heel section and a concave toe section.

In accordance with a second aspect of the present invention, a head main body of a golf club has a sole face defined by a convex sphere of a prescribed radius of curvature.

In accordance with a third aspect of the present invention, the head main body of a golf club head includes crown and sole faces which are defined by a convex sphere of a prescribed radius of curvature and formed with vertical symmetry.

BRIEF DESCRIPTION OF THE DRAWINGS

FIG. 3 is a perspective view of a wood type golf club head in accordance with the second aspect of the present invention, FIG. 4 is a side view of the golf club head shown in FIG. 3, FIG. 7 is a plan view of the golf club head shown in FIG. 6, FIG. 8 is a plan view, partly in section, of an iron type golf club head in accordance with the first aspect of the present invention.

DESCRIPTION OF THE PREFERRED EMBODIMENTS

Figure 1:
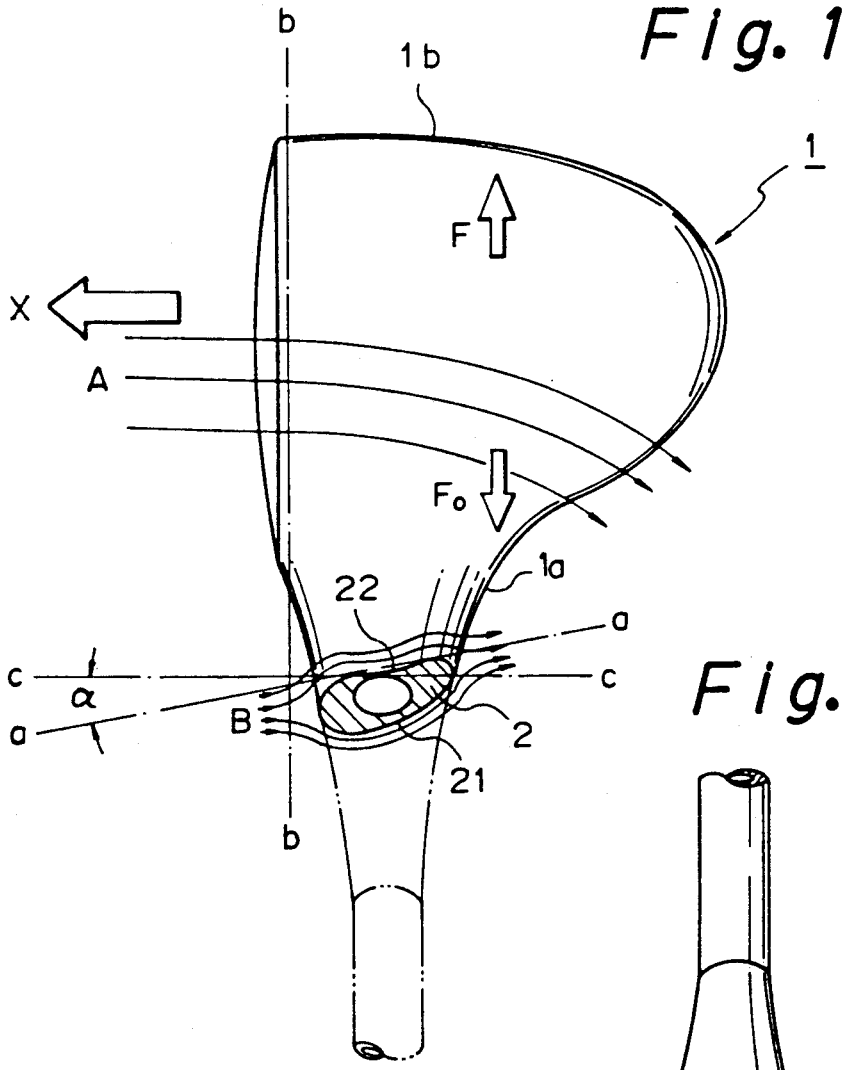
FIG. 1 is a plan view, partly in section, of a wood type golf club head in accordance with the first aspect of the present invention.
Figure 2:
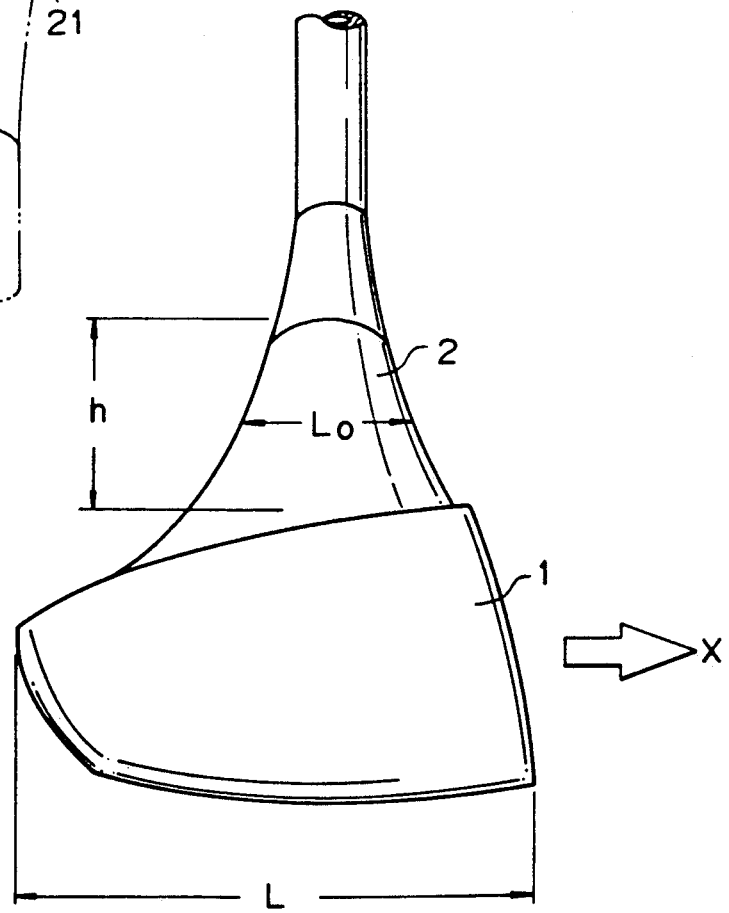
FIG. 2 is a side view of the golf club head shown in FIG. 1.

One embodiment of the golf club head in accordance with the first aspect of the present invention is shown in FIGS. 1 and 2, in which a golf club head includes a head main body 1 and a hosel 2 coupled to form a single body. The transverse cross-section of the hosel 2 has a winged profile which is defined by a convex heel section 21 on the side of the heel face 1*a* and a concave toe section 22 on the side of the toe face 1*b*. A secant a—a of the winged profile on the side of the concave toe section 22 is inclined with respect to the shooting direction X by a secant angle $\alpha$. In FIG. 1, a maximum width line b—b normal to the shooting direction X passes two spaced points on the section of the head main body 1 of the maximum width and a standard line c—c is perpendicular to the maximum width line b—b. The secant a—a of the wing profile intersects with this standard line c—c at the secant angle $\alpha$. The secant angle $\alpha$ is preferably in a range from 25° to 40°.

The above-described winged profile should preferably be formed in an area half of the height h of the hosel 2 shown in FIG. 2. The depth $L_o$ of the hosel 2 in the shooting direction at the middle of its height h should preferably be at least ½ of the entire depth of the head main body 1.

Due to the winged profile and specified secant angle $\alpha$ of the hosel, air current B near the hosel 2 generates a negative bias $F_o$ directed towards the heel face 1*a* of the head main body 1 and this negative bias $F_o$ effectively offsets a positive bias F generated by air current A near the head main body 1 and directed towards the toe face 1*b* of the head main body 1, thereby effectively stabilizing the swing line. Further, the winged profile of the transverse cross-section of the hosel 1 prevents current transition on the rear side of the hosel 2, thereby preventing reduction in the head speed.

In the case of the illustrated construction, the winged profile is defined by the convex heel section combined with the concave toe section. The combination is not limited to this example. For example, a flat heel section may be combined with a concave toe section or a convex heel section may be combined with a flat toe section.

One embodiment of the golf club head in accordance with the second aspect of the present invention is shown in FIGS. 3 and 4 in which the sole face 5 of a head main body 1 is formed by a convex sphere of a prescribed radius of curvature R. Except for edge lines 8*a* and 8*b* bordering the shooting face 8, the crown face 3, the back face 4, the sole face 5 and the toe and heel side faces 6, 7 are formed continuously without the presence of any acute angle edge lines.

The radius of curvature R defining the convex sphere for the sole face 5 should preferably be in a range from 0.2 to 0.5 m. Any radius of curvature R below 0.2 m would excessively minimize the positive buoyancy generated by the crown and sole faces 3, 5 when the club is swung and movement of the head main body 1 is likely to be influenced by the negative buoyancy. When the radius of curvature R exceeds 0.5 m, the positive buoyancy generated by the crown and sole faces 3, 5 is too great, as in the case of the conventional golf club head.

In accordance with the above-described configuration of the golf club head, the sole face defined by a sphere of a specified radius of curvature and the absence of edge lines between various faces concur to offset the negative buoyancy due to the loft of the shooting face with the positive buoyancy generated by the crown and sole faces as shown in FIG. 4.

Even when current transition starts at the border between the lower edge 8*b* of the shooting face 8 and the sole face 5, the absence of edge lines between various faces allows reunion of the parallel flow on the rear side of the back face, thereby reducing the pneumatic resistance.

Figure 5:
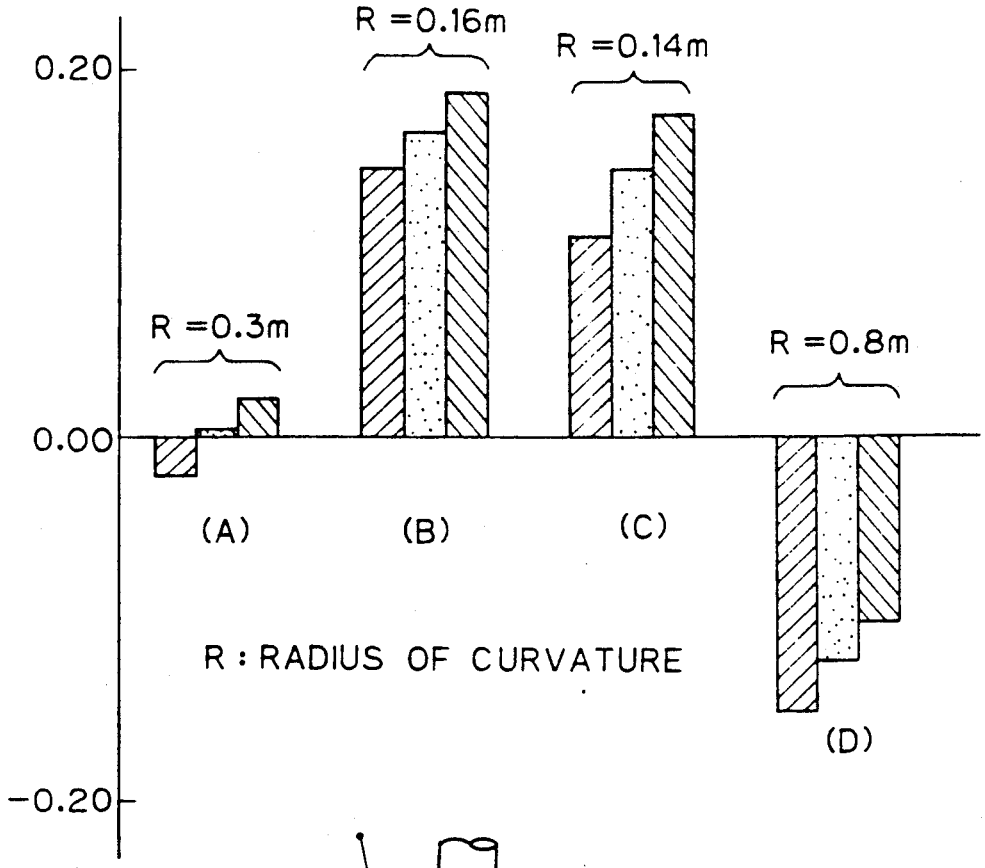
FIG. 5 is a graph for showing the relationship between the buoyancy factor and the radius of curvature.

The relationship between the buoyancy factor of a golf club head and the radius of curvature defining its spherical sole face is shown in FIG. 5 in which the buoyance factor C is taken on the ordinate and the radius of curvature R is taken on the abscissa. In the graph, A is for a golf club head of R=0.3 m (the present invention), B for R=0.16 m, C for R=0.14 and D for R=0.8. Here, the buoyancy factor C is given by the following equation.

$$C=F/[(\tfrac{1}{2})\cdot V^2\cdot\rho\cdot A]$$

v; head speed $\rho$; air density

A; projected surface area in the shooting direction

In each group of columns, the left column is for v=30 m/sec, the middle column is for v=40 m/sec and the right column is for v=50 m/sec, respectively. It is clearly observed that the buoyancy factor of the golf club head of the present invention is much smaller than those of conventional golf club heads.

Figure 6:
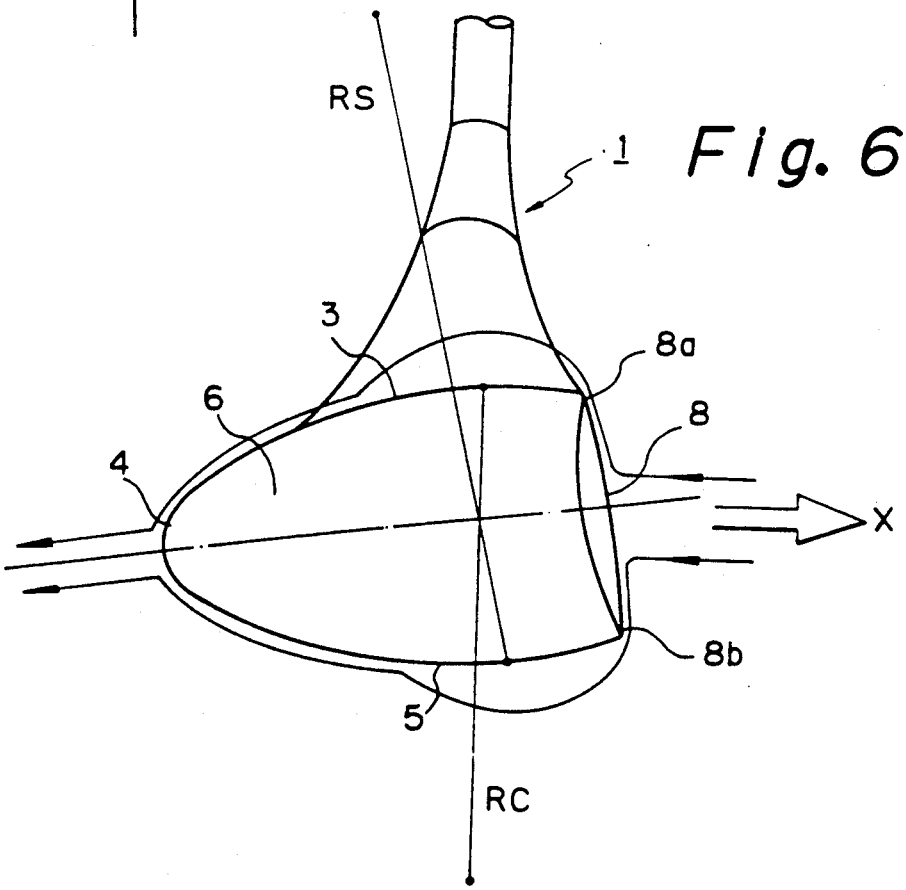
FIG. 6 is a side view of a wood type golf club head in accordance with the third aspect of the present invention.

One embodiment of the golf club head in accordance with the third aspect of the present invention is shown in FIGS. 6 and 7 in which, as shown in FIG. 6, the crown face 3 is defined by a sphere of a prescribed radius of curvature RC and the sole face 5 is defined by a sphere of a similar radius of curvature RS, respectively. Most preferably, the two radii RC and RS are identical to each other so that the crown and sole faces have complete vertical symmetry.

Further, as shown in FIG. 7, the entire depth L of the head main body in the shooting direction is close to the width W of the shooting face 8. The difference between the depth L and the width W should preferably be no more than 10% of the width W. More specifically, the difference should preferably be 8 mm or smaller, and more preferably be 5 mm of smaller. The radius of curvature of the edge lines should preferably be 5 mm or smaller.

Figure 11:
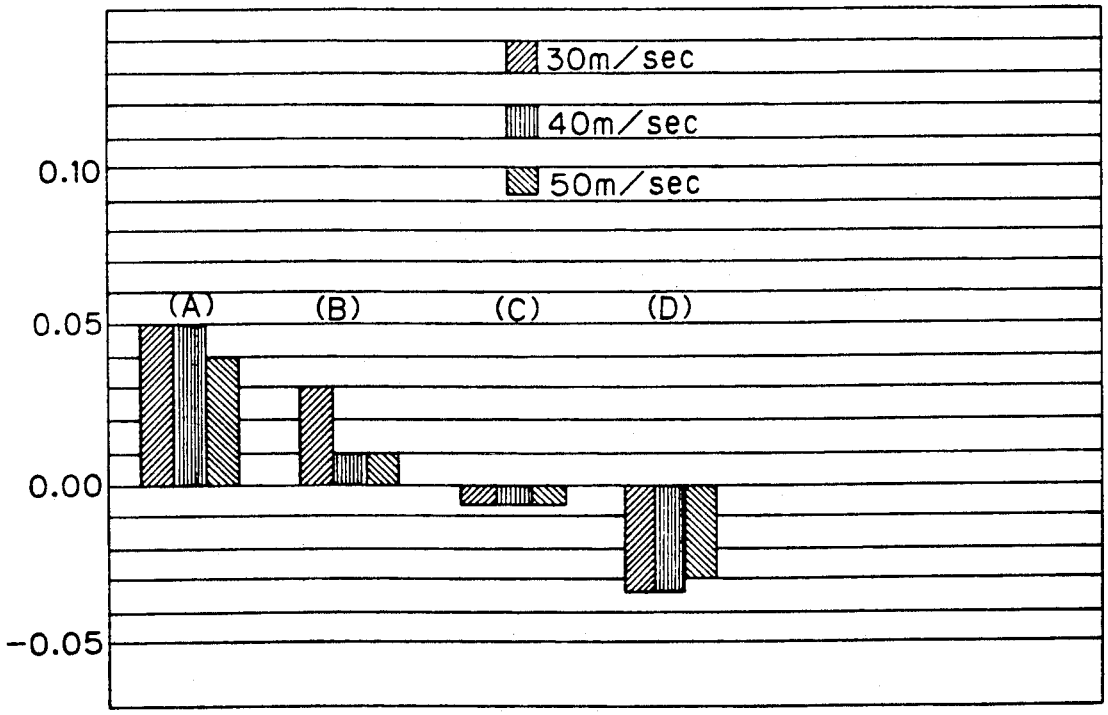
FIG. 11 is a graph showing the relationship between the lateral force coefficient and the hosel angle.

The relationship between the lateral force coefficient (Cs) and the hosel angle ($\alpha$) is shown in FIG. 11 in which the hosel angle ($\alpha$) is taken on the abscissa and the lateral force coefficient (Cs) is taken on the ordinate. Here, the term "lateral force" refers to a force acting on the club head in a direction perpendicular to the swing line whereas the term "hosel angle" refers to the angle of inclination of the winged profile in the hosel with respect to the swing line.

In the illustration, (A) corresponds to a club head having hosel angle of 0 degrees, (B) to a club head having hosel angle, of 25 degrees (C) to a club head having hosel angle of 80 degrees and (D) to a club head of 80 degrees hosel angle.

Figure 9:
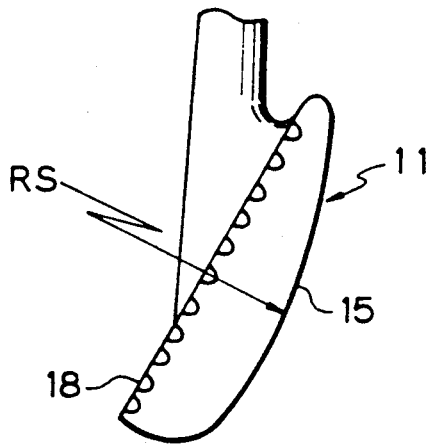
FIG. 9 is a side view of an iron type golf club head in accordance with the second aspect of the present invention.
Figure 10:
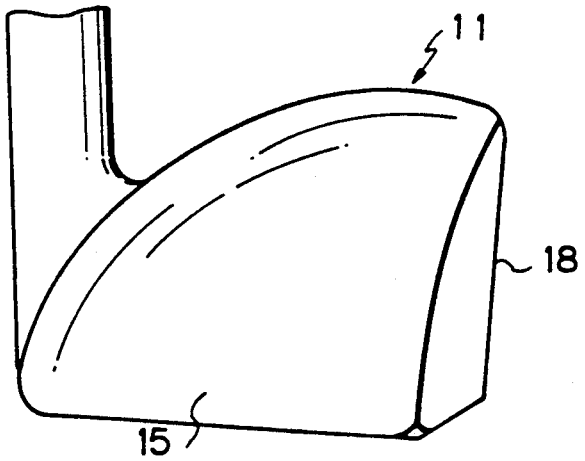
FIG. 10 is a rear view of the golf club head shown in FIG. 9.

In the case of the foregoing embodiments, the present invention is applied to wood type golf club heads only. It should be understood, however, that some aspects of the present invention are also well applicable to iron type club heads with the same advantages. One example is shown in FIG. 8 in which the hosel 12 of the head main body 11 is provided with a transverse cross-section defined by a winged profile. The winged profile is defined by a convex heel section 21 and a concave toe section 22 and the secant a—a of the winged profile intersects with the standard line c—c at a secant angle of $\alpha$. Another example is shown in FIGS. 9 and 10 in which the sole face 15 is defined by a sphere of a prescribed radius of curvature RS.

What is claimed is:

1. A golf club head comprising a head main body having a toe section and a heel section; and a hosel adapted to receive a golf club shaft and attached to the main body at the heel section and having a winged profile transverse cross-section defined by a convex side substantially facing the heel section as seen from a plan view of said club head and a concave side substantially facing the toe section as seen from a plan view of said club head.

2. A golf club head as claimed in claim 1 wherein a standard line is drawn in a region of said hosel parallel to a direction of club swing and perpendicular to an imaginary line drawn parallel to a plane containing a portion of the club head main body having a maximum width and a secant line to said winged profile on a side of the winged profile facing the toe section intersects with the standard line at a secant angle of 25° or larger.

3. A golf club head as claimed in claim 1 wherein the head comprises wood.

4. A golf club head as claimed in claim 3 wherein a standard line is drawn in a region of said hosel parallel to a direction of club swing and perpendicular to an imaginary line drawn parallel to a plane containing a portion of the club head main body having a maximum width and a secant line to said winged profile on a side of said winged profile facing the toe section intersects with the standard line at a secant angle of 40° or smaller.

5. A golf club head as claimed in claim 3 wherein a standard line is drawn in a region of said hosel parallel to a direction of club swing and perpendicular to an imaginary line drawn parallel to a plane containing a portion of the club head main body having a maximum width and a secant line to said winged profile on a side of said winged profile facing the toe section intersects with the standard line at a secant angle in a range from 25° to 40°.

6. A golf club head comprising a head main body having a heel section and a toe section; and a hosel adapted to receive a golf club shaft and attached to the main body at the heel section and having a winged profile transverse cross-section defined by a convex side substantially facing the heel section as seen from a plan view of said club head and a concave side substantially facing the toe section as seen from a plan view of said club head, said hosel having a height, said winged profile being formed in an area disposed approximately at half of the height of said hosel.

7. A golf club head as claimed in claim 6 wherein said head main body has a total depth in the direction of club swing; and said hosel has a depth in the direction of club swing at approximately the middle of the height of at least ½ of the total depth of said head main body in said direction of club swing.

8. A golf club head as claimed in claim 7 wherein the head comprises wood.

9. A golf club head as claimed in claim 7 wherein said golf club head main body has a sole face having a radius of curvature of 0.2 m or larger.

10. A golf club head as claimed in claim 7 wherein said golf club head main body has a sole face having a radius of curvature in a range from 0.2 to 0.5 m.

11. A golf club head comprising a head main body having a toe end and a heel end, the head main body generating a first force in a first direction from the heel end to the toe end when a club is swung by a user;

a hosel portion provided on said head main body for attachment of a golf club shaft, said hosel portion including means for generating a second force directed from the toe end to the heel end of said head main body substantially opposite to said first direction and at least in part counteracting said first force when said club is swung, the cross-sectional shape of said hosel portion having a winged profile, thereby stabilizing said club when swung, the winged profile having a concave shape substantially facing the toe end and a convex shape facing away from the toe end.

12. A golf club head as claimed in claim 11, wherein the head comprises wood.

13. A golf club head as claimed in claim 11, wherein:

a standard line is drawn in a region of said hosel portion parallel to a direction of club swing and perpendicular to an imaginary line drawn parallel to a plane containing a portion of the club head main body having a maximum width; and a secant line to said winged profile on a side of said winged profile facing the toe end intersects with the standard line at a secant angle of 25° or larger.

14. A golf club head as claimed in claim 11, wherein:

a standard line is drawn in a region of said hosel portion parallel to a direction of club swing and perpendicular to an imaginary line drawn parallel to a plane containing a portion of the club head main body having a maximum width; and a secant line to said winged profile on a side of said winged profile facing the toe end intersects with the standard line at a secant angle of 40° or smaller.

15. A golf club head as claimed in claim 11, wherein:

a standard line is drawn in a region of said hosel portion parallel to a direction of club swing and perpendicular to an imaginary line drawn parallel to a plane containing a portion of the club head main body having a maximum width; and a secant line to said winged profile on a side of said winged profile facing the toe end intersects with the standard line at a secant angle of in a range from 25° to 40°.

16. A golf club head as claimed in claim 24, wherein:

said hosel portion has a height, the winged profile being formed in an area disposed approximately at half the height of the hosel portion.

17. A golf club head as claimed in claim 16, wherein:

said head main body has a total depth in the direction of club swing and the hosel portion has a depth in the direction of club swing at approximately the middle of the height of at least one half of the total depth of said head main body in the direction of club swing.

18. A golf club head as claimed in claim 17, wherein said golf club head main body has a downwardly directed sole face having a radius of curvature of 0.2 m or larger.

19. A golf club head as claimed in claim 17, wherein said golf club head main body has a downwardly directed sole face having a radius of curvature in a range from 0.2 m to 0.5 m.

* * * * *